US008082858B2

(12) United States Patent
Yoshizawa

(10) Patent No.: US 8,082,858 B2
(45) Date of Patent: Dec. 27, 2011

(54) DISPLAY SUBSTRATE ACCOMMODATING TRAY AND APPARATUS AND METHOD FOR REMOVING THE DISPLAY SUBSTRATE

(75) Inventor: Takenori Yoshizawa, Tsu (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/630,731

(22) Filed: Jul. 31, 2003

(65) Prior Publication Data

US 2004/0020823 A1 Feb. 5, 2004

(30) Foreign Application Priority Data

Jul. 31, 2002 (JP) ..... 2002-223093

(51) Int. Cl.
*B65D 19/38* (2006.01)

(52) U.S. Cl. ..... 108/53.1; 108/53.3; 206/562; 206/565

(58) Field of Classification Search ..... 248/346.01, 248/346.02, 346.5; 108/53.1, 53.3, 53.5, 108/91, 51.11, 52.1; 211/49.1, 59.1, 59.4; 206/503, 504, 562, 563, 565, 821, 557, 564, 206/509, 427

See application file for complete search history.

(56) References Cited

U.S. PATENT DOCUMENTS

| | | | | | |
|---|---|---|---|---|---|
| 3,695,424 | A | * | 10/1972 | Cristy et al. | 206/455 |
| 4,759,451 | A | * | 7/1988 | Apps | 211/126.4 |
| 4,972,951 | A | * | 11/1990 | Vartanian | 206/387.1 |
| 5,287,991 | A | * | 2/1994 | Koda et al. | 220/769 |
| 5,344,022 | A | * | 9/1994 | Stahl | 206/507 |
| 5,752,602 | A | * | 5/1998 | Ackermann et al. | 206/507 |
| 6,010,005 | A | * | 1/2000 | Reames et al. | 206/557 |
| 6,070,731 | A | | 6/2000 | Kobayashi et al. | |
| 6,116,427 | A | * | 9/2000 | Wu et al. | 206/706 |
| 6,260,706 | B1 | * | 7/2001 | Koefelda | 206/505 |
| 6,749,065 | B1 | * | 6/2004 | Hammett | 206/509 |

FOREIGN PATENT DOCUMENTS

| | | | | |
|---|---|---|---|---|
| JP | 7-15742 | | | 7/1995 |
| JP | 10-287382 | A | | 10/1998 |
| JP | 11-59893 | A | | 3/1999 |
| JP | 2003236953 | A | * | 8/2003 |

* cited by examiner

*Primary Examiner* — A. Joseph Wujciak, III

(74) *Attorney, Agent, or Firm* — Birch, Stewart, Kolasch & Birch, LLP

(57) ABSTRACT

A display substrate accommodating tray includes a bottom section for mounting a display substrate thereon in a substantially horizontal fashion; and a frame for surrounding at least a part of the display substrate when the display substrate is mounted on the bottom section. A plurality of openings are formed in the bottom section through which a plurality of supporting members are to be inserted for, when the display substrate is mounted on the bottom section, raising the mounted display substrate above the bottom section.

11 Claims, 7 Drawing Sheets

DISPLAY SUBSTRATE ACCOMMODATING TRAY AND APPARATUS AND METHOD FOR REMOVING THE DISPLAY SUBSTRATE

This nonprovisional application claims priority under 35 U.S.C. §119(a) on Patent Application No(s). 2002-223093 filed in JAPAN on Jul. 31, 2002, which is(are) herein incorporated by reference.

BACKGROUND OF THE INVENTION

1. Field of the Invention

The present invention relates to a display substrate accommodating tray used for transporting a display substrate such as, for example, a glass substrate used for producing a display panel for a liquid crystal display device or the like; and an apparatus and method for removing the display substrate from such a display substrate accommodating tray.

2. Description of the Related Art

A display panel for a liquid crystal display device usually includes a pair of glass substrates opposed to each other and sealed together, and a liquid crystal material sealed between the pair of glass substrates. In order to produce such a display panel, glass substrates are transported to a display panel production plant. For transporting the glass substrates, a glass substrate accommodating box for accommodating a plurality of glass substrates is usually used. Glass substrates are used in display panels of various types of display devices as well as liquid crystal display devices. The above-mentioned type of glass substrate accommodating box is also used for transporting glass substrates used for the various types of display devices other than liquid crystal display devices.

The same type of glass substrate accommodating box is used for transporting glass substrates with electrodes and the like formed thereon as half-finished products.

Recently, glass substrates having a thickness of 0.7 mm or less are widely used for various types of display panels. The planar area of the glass substrates which are carried to the display panel production plants is increasing, and even glass substrates having a side length of 1.3 m or greater are used.

Such a large and thin glass substrate is easily warped. When a plurality of such glass substrates are accommodated in the box, the glass substrates may be warped and contact each other, and break during transportation. In order to avoid this, it is necessary to keep an appropriate distance between the glass substrates in the box.

For example, a glass substrate having a thickness of 0.7 mm and a side length of 1.3 m or greater, when supported along the periphery thereof with a support having a width of 20 to 30 mm, may be warped by 90 mm or greater at the center thereof. In a glass substrate accommodating box, it is necessary to keep a distance of 100 mm or greater between the glass substrates in the box.

A glass substrate is usually removed from a glass substrate accommodating box using a glass substrate adsorption hand. The glass substrate adsorption hand has a pair of flat adsorption pads. Each adsorption pad needs to be inserted between two adjacent glass substrates, which requires a space for inserting the adsorption pad. A flat adsorption pad usually has a thickness of about 20 mm. Therefore, the distance between the glass substrates in the box needs to be the sum of a distance sufficient for preventing the glass substrates from contacting each other even when the glass substrates are warped and a distance of about 20 mm for inserting the adsorption pad.

Due to the necessary space between two adjacent glass substrates, the number of glass substrates which can be accommodated in a glass substrate accommodating box having a prescribed size is limited. This lowers the space efficiency for transportation and storage, i.e., the number of glass substrates which can be accommodated per unit volume.

The space efficiency can be increased to some extent by increasing the size of glass substrate accommodating boxes so that a greater number of glass substrates can be accommodated in each box and thus a smaller number of boxes are required for accommodating the same number of glass substrates. However, a glass substrate having a side length of 1.3 m or greater is as heavy as about 5 kg. A glass substrate accommodating box accommodating a large number of (for example, 20) glass substrates may not be able to be carried by one worker.

In order to solve these problems, Japanese Laid-Open Publication No. 10-287382 discloses a substrate tray cassette for accommodating one glass substrate. The substrate tray cassette has a bottom section having a lattice structure. The substrate tray cassette is structured such that a plurality of substrate tray cassettes can be stacked vertically. Such a substrate tray cassette allows a large and thin glass substrate to be accommodated without being warped and thus without being broken during transportation. Since a greater number of substrate tray cassettes can be stacked vertically for transportation and storage, the space efficiency can be improved.

However, this substrate tray cassette has the following problems. The accommodated glass substrate is supported by resin pins, and a pair of adsorption pads of a glass substrate adsorption hand are put into the space below the glass substrate. Such a space for the adsorption pads increases the size of the substrate tray cassette. In addition, the lattice structure of the substrate tray cassette presents a problem in terms of the rigidity thereof, and thus the number of substrate tray cassettes which can be stacked vertically is limited.

SUMMARY OF THE INVENTION

According to one aspect of the invention, a display substrate accommodating tray includes a bottom section for mounting a display substrate thereon in a substantially horizontal fashion; and a frame for surrounding at least a part of the display substrate when the display substrate is mounted on the bottom section. A plurality of openings are formed in the bottom section through which a plurality of supporting members are to be inserted for, when the display substrate is mounted on the bottom section, raising the mounted display substrate above the bottom section.

In one embodiment of the invention, the frame is provided along a periphery of the bottom section and projects to a level higher than a level of a top surface of the bottom section.

In one embodiment of the invention, the frame has a positioning portion for determining the positional relationship between the display substrate accommodating tray and another display substrate accommodating tray which is to be stacked thereon.

In one embodiment of the invention, the display substrate accommodating tray further includes an engaging section engageable with a carrying member for carrying the display substrate accommodating tray having a display substrate mounted thereon.

In one embodiment of the invention, the bottom section and the frame are integrally formed from a synthetic resin foam material.

According to another aspect of the invention, an apparatus for removing a display substrate from a display substrate accommodating tray is provided. The display substrate accommodating tray includes a bottom section for mounting a display substrate thereon in a substantially horizontal fashion, with a plurality of openings being formed in the bottom section, and a frame for surrounding at least a part of the display substrate when the display substrate is mounted on the bottom section. The apparatus includes a plurality of first supporting members for, when the display substrate is mounted on the bottom section, raising the mounted display substrate above the bottom section; and a second supporting member for supporting the display substrate accommodating tray. The plurality of first supporting members raise the mounted display substrate by moving upward relative to the display substrate accommodating tray and thus being inserted into the plurality of openings respectively.

In one embodiment of the invention, the plurality of first supporting members are inserted into the plurality of openings vertically.

According to still another aspect of the invention, a method for removing a display substrate from a display substrate accommodating tray is provided. The display substrate accommodating tray includes a bottom section for mounting a display substrate thereon in a substantially horizontal fashion, with a plurality of openings being formed in the bottom section, and a frame for surrounding at least a part of the display substrate when the display substrate is mounted on the bottom section. The method comprising the steps of when the display substrate is mounted on the bottom section, moving a plurality of supporting members upward relative to the display substrate accommodating tray, thereby inserting the plurality of supporting members into the plurality of openings respectively; and raising the mounted display substrate above the bottom section by the plurality of supporting members.

Thus, the invention described herein makes possible the advantages of providing a display substrate accommodating tray for accommodating a great number of display substrates in a limited space and allowing the display substrates to be transported and stored with high efficiency without contacting each other, and an apparatus and a method for easily removing the display substrates accommodated in the display substrate accommodating tray.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the accompanying drawings.

Figure 1:
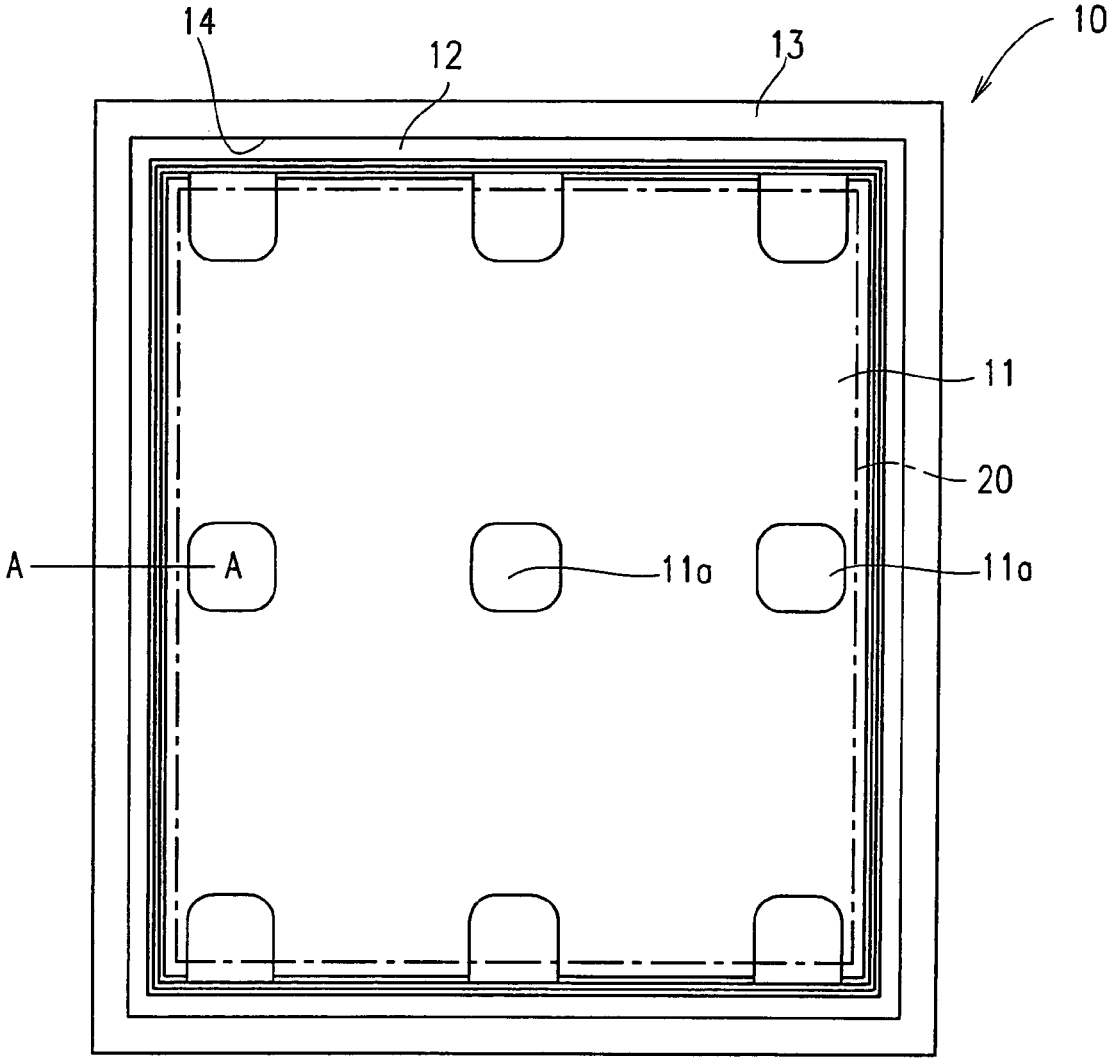
FIG. 1 is a plan view of a display substrate accommodating tray according to an example of the present invention.
Figure 2:
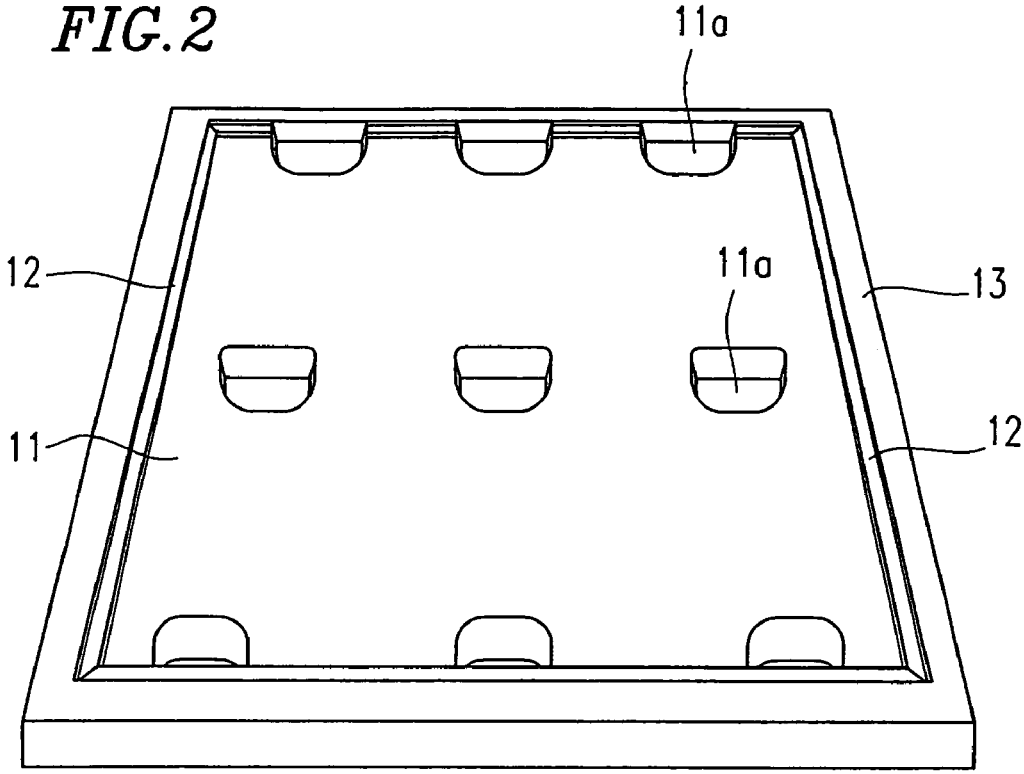
FIG. 2 is a perspective view of the display substrate accommodating tray shown in FIG. 1.
Figure 3:
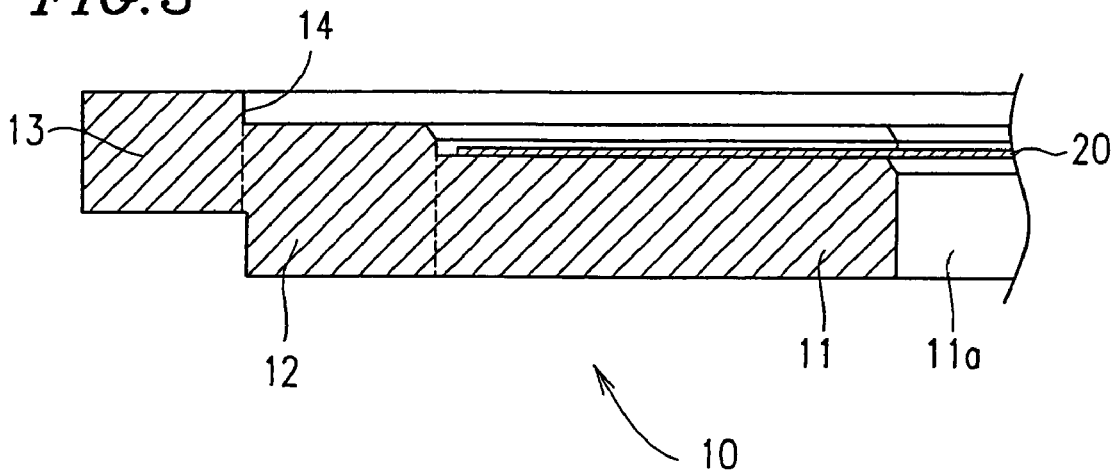
FIG. 3 is a partial cross-sectional view of the display substrate accommodating tray shown in FIG. 1.

FIG. 1 is a plan view illustrating a display substrate accommodating tray 10 according to an example of the present invention. FIG. 2 is a perspective view of the display substrate accommodating tray 10, and FIG. 3 is a partial cross-sectional view of the display substrate accommodating tray 10 taken along line A-A in FIG. 1. The display substrate accommodating tray 10 is useful for accommodating a glass substrate used for, for example, a liquid crystal display panel; specifically, a glass substrate having a side length of 1.3 m or greater and a thickness of 0.7 mm or less, for transportation or storage.

The display substrate accommodating tray 10 according to the present invention is molded to be a thin rectangular parallelepiped. The display substrate accommodating tray 10 includes a rectangular bottom section 11 for mounting thereon a glass substrate 20 as a display substrate in a substantially horizontal fashion, and a frame 12 for surrounding the entire periphery of the glass substrate 20 when the glass substrate 20 is mounted on the bottom section 11. The frame 12 is provided along the entire periphery of the bottom section 11, and projects to a level higher than the level of a top surface of the bottom section 11. The bottom section 11 and the frame 12 are integrally molded from a foam polyethylene resin, which is a synthetic resin foam material, or the like. The frame 12 may be provided along the periphery of the bottom section 11 such that the frame 12 surrounds at least a part of the glass substrate 20.

The bottom section 11 has a rectangular shape which is slightly larger than the glass substrate 20, and has a thickness of, for example, about 15 mm. The glass substrate 20 is mounted on the top surface of the bottom section 11.

Square openings 11*a* are formed in the vicinity of the corners of the bottom section 11 and at intermediate positions between the corners along the four sides of the bottom section 11. A square opening 11*a* is also formed at the center of the bottom section 11. Thus, the bottom section 11 has nine openings 11*a* in a 3×3 matrix. Support pins 43 (FIG. 6) can be inserted into the openings 11*a* as supporting members. The support pins 43 raise the glass substrate 20 from the bottom section 11 for removing the glass substrate 20 from the display substrate accommodating tray 10.

The frame 12 is provided along the entire periphery of the bottom section 11 as described above, and has a width of about 30 mm. The frame 12 projects to a level higher than the level of the top surface of the bottom section 11 by about 5 mm or greater. The frame 12 surrounds the entire periphery of the glass substrate 20 mounted on the bottom section 11 at an appropriate distance from the edge of the glass substrate 20.

An engaging section 13 is provided along the entire periphery of the frame 12. More specifically, the engaging section 13 is provided such that a step is formed between a bottom surface of the engaging section 13 and a bottom surface of the frame 12, and projects to a level higher than a top surface of the frame 12. The engaging section 13 has a width of, for example, about 30 mm and horizontally projects outward from the frame 12. The engaging section 13 has a rectangular cross-section, and is engageable with a chuck nail (not shown in FIG. 1) for chucking. The chuck nail acts as a transfer member for transferring the display substrate accommodating tray 10 to a prescribed position. The bottom section 11, the frame 12, and the engaging section 13 may be integrally molded from a foam polyethylene resin or the like.

A top surface of the engaging section 13 extends horizontally outside and above the top surface of the frame 12. The frame 12 has a positioning step 14 (positioning portion; FIG. 3), which is provided between the top surface of the engaging section 13 and the top surface of the frame 12. The positioning step 14 is vertical to the top surface of the frame 12. The positioning step 14 is provided along the periphery of the frame 12, and acts to determine the positional relationship between the display substrate accommodating tray 10 and another display substrate accommodating tray 10 which is to be stacked thereon.

In the display substrate accommodating tray 10 having the above-described structure, the glass substrate 20 (for example, a glass substrate for a liquid crystal panel having a thickness of 0.7 mm or less) is accommodated on the top surface of the bottom section 11. A surface of the glass substrate 20 which does not have electrodes or the like is in contact with the top surface of the bottom section 11. As described above, the bottom section 11 is slightly larger than the glass substrate 20, and thus the glass substrate 20 is mounted on the bottom section 11 at an appropriate distance from the edge of the frame 12.

Figure 4:
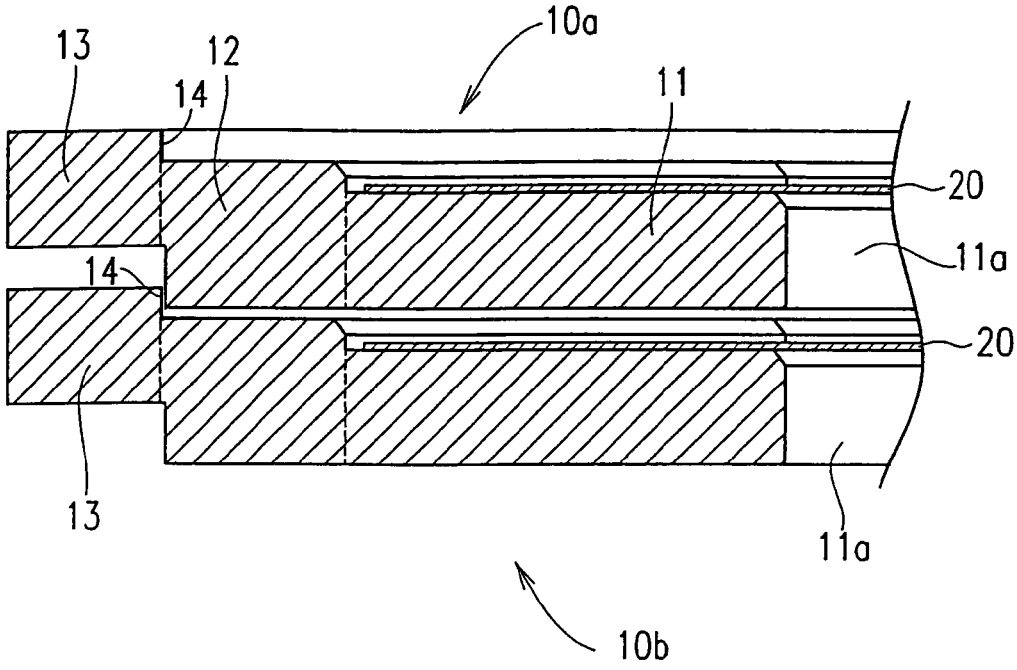
FIG. 4 is a partial cross-sectional view of two display substrate accommodating trays, each of which is shown in FIG. 1, stacked vertically.

As shown in FIG. 4, a plurality of display substrate accommodating trays 10 (only two are shown in FIG. 4 for the sake of simplicity) each accommodating a glass substrate 20 can be stacked vertically and transported in this state. A bottom edge of the frame 12 of an upper display substrate accommodating tray (indicated by reference numeral 10*a* for the sake of clarity) is engaged with the positioning step 14 of a lower display substrate accommodating tray (indicated by reference numeral 10*b* for the sake of clarity). Therefore, the display substrate accommodating trays 10*a* and 10*b* stacked vertically do not slip in a horizontal direction with respect to each other.

For example, about 20 display substrate accommodating trays 10 each accommodating a glass substrate 20 can be stacked vertically and transported. Each display substrate accommodating tray 10 is thin as described in detail below, and thus significantly improves the space efficiency. As a result, a great number of glass substrates 20 can be transported and stored with high efficiency.

Figure 5:
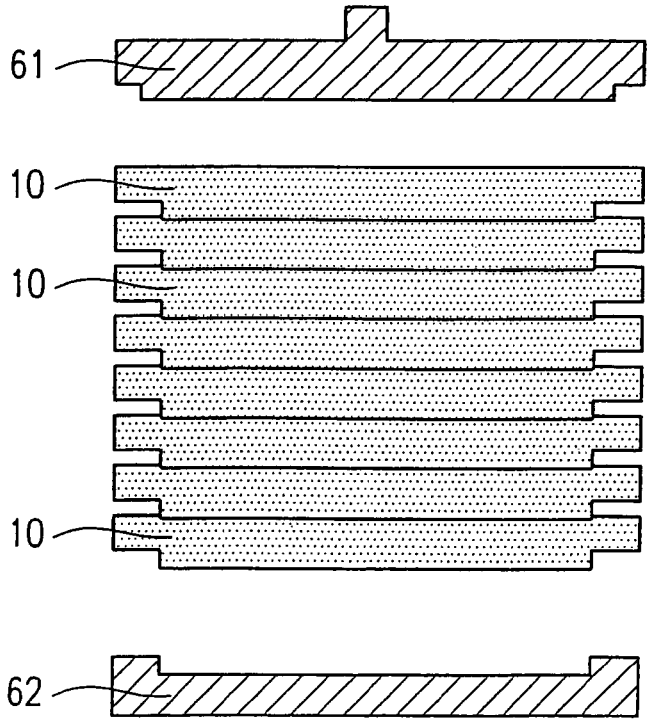
FIG. 5 is a cross-sectional view of a plurality of display substrate accommodating trays, each of which is shown in FIG. 1, stacked vertically for transportation and storage.

For actual transportation of a prescribed number of display substrate accommodating trays 10, a lid 61 and a bottom plate 62 shown in FIG. 5 are engaged with an uppermost display substrate accommodating tray 10 and a lowermost display substrate accommodating tray 10, respectively. The plurality of vertically stacked display substrate accommodating trays 10 are transported and stored with the lid 61 and the bottom plate 62 as one unit. The lid 61 is engaged with the positioning step 14 of the uppermost display substrate accommodating tray 10 and thus seals the uppermost display substrate accommodating tray 10. Therefore, the glass substrate 20 accommodated in the uppermost display substrate accommodating tray 10 is protected against dust or the like.

The bottom plate 62 is engaged with the bottom section 11 and the frame 12 (FIG. 3) of the lowermost display substrate accommodating tray 10. Therefore, the glass substrate 20 accommodated in the lowermost display substrate accommodating tray 10 is protected against dust or the like.

The glass substrates 20 accommodated in the vertically stacked display substrate accommodating trays 10 can be transported by a truck or the like while being sealed by the lid 61, the bottom plate 62, the frame 12 and the engaging section 13. Therefore, a container or the like for accommodating the display substrate accommodating trays 10 is not necessary.

In such a stacked structure, the weight of an upper display substrate accommodating tray 10 is supported by the frame 12 of the display substrate accommodating tray 10 below. Especially when a great number of display substrate accommodating trays 10 are stacked, the width of the frame 12 is increased in order that the lowermost display substrate accommodating tray 10 (FIG. 5) is not broken. For example, when ten display substrate accommodating trays 10 each accommodating a glass substrate 20 are stacked vertically, the width of the frame 12 is preferably about 100 mm.

The frame 12 may be reinforced by a reinforcing material such as metal or the like.

Instead of using the lid 61 and the bottom plate 62, a prescribed number of display substrate accommodating trays 10 may merely be stacked and put into a container, for example, a metal box. In this case, a plurality of such metal boxes can be stacked vertically, which further improves the space efficiency during transportation.

A bottom surface of the frame 12 of the uppermost display substrate accommodating tray 10 is engaged with the positioning step 14 of the display substrate accommodating tray 10 below. Therefore, there is an appropriate space between the engaging section 13 of the uppermost display substrate accommodating tray 10 and the engaging section 13 of the display substrate accommodating tray 10 below. This allows a chuck nail to be inserted between these engaging sections 13. The chuck nail is engaged with the engaging section 13 of the uppermost display substrate accommodating tray 10, so that only the uppermost display substrate accommodating tray 10 can be separated from the other display substrate accommodating trays 10 in the stack.

Figure 6:
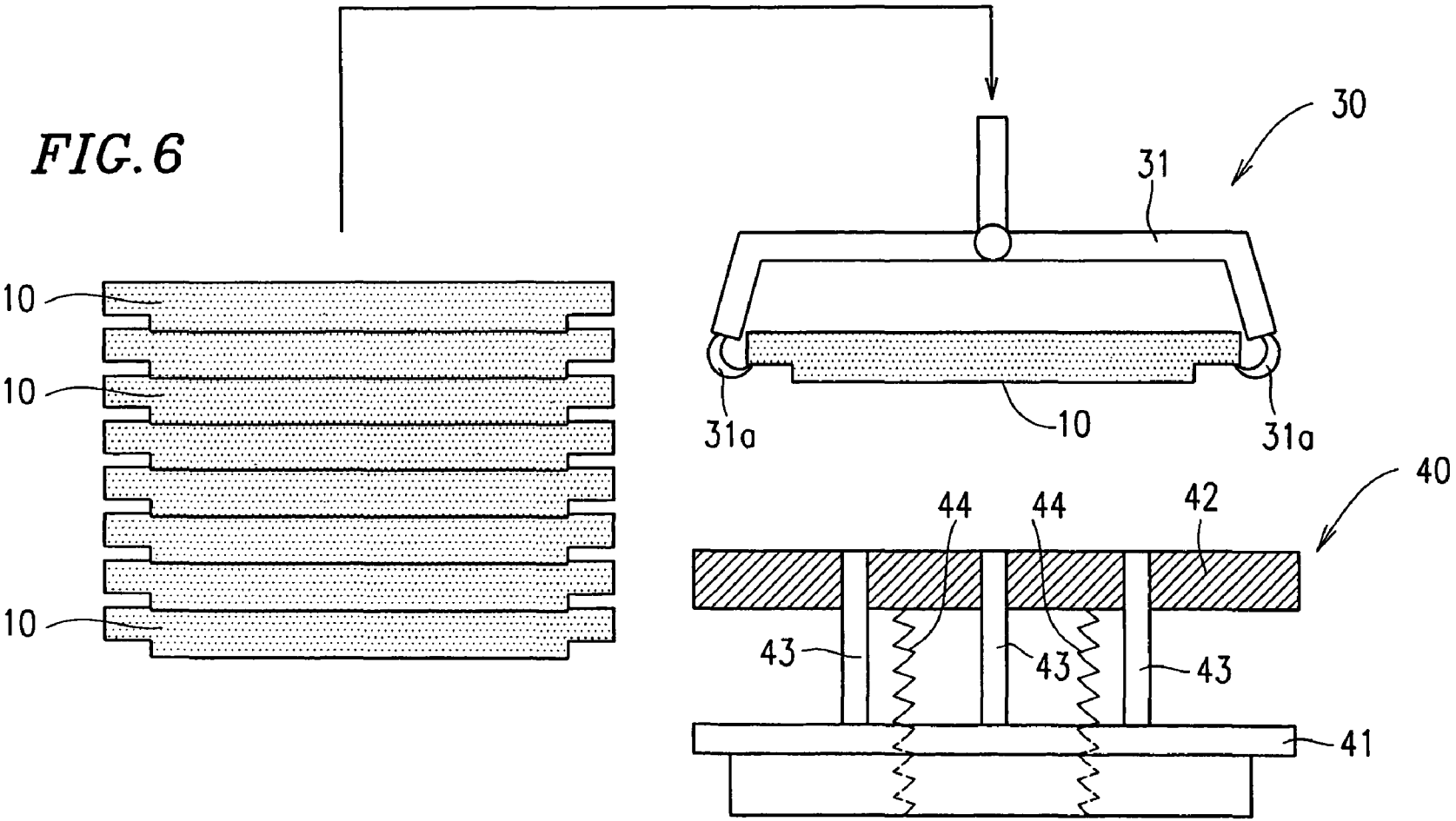
FIG. 6 is a schematic view of a carrying apparatus and a display substrate removing apparatus according to an example of the present invention.
Figure 7:
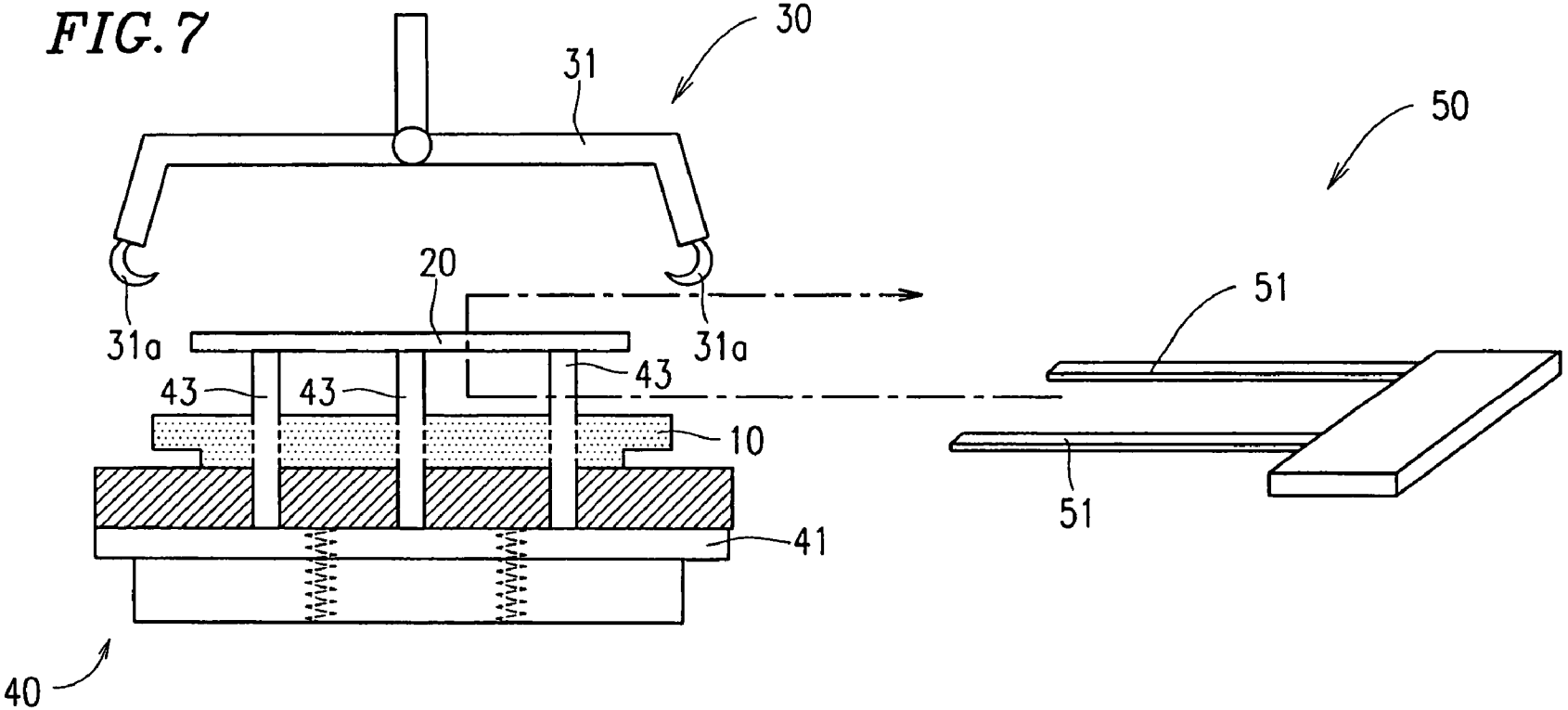
FIG. 7 is a schematic view of the carrying apparatus and the display substrate removing apparatus shown in FIG. 6 with a display substrate adsorption hand.
Figure 8:
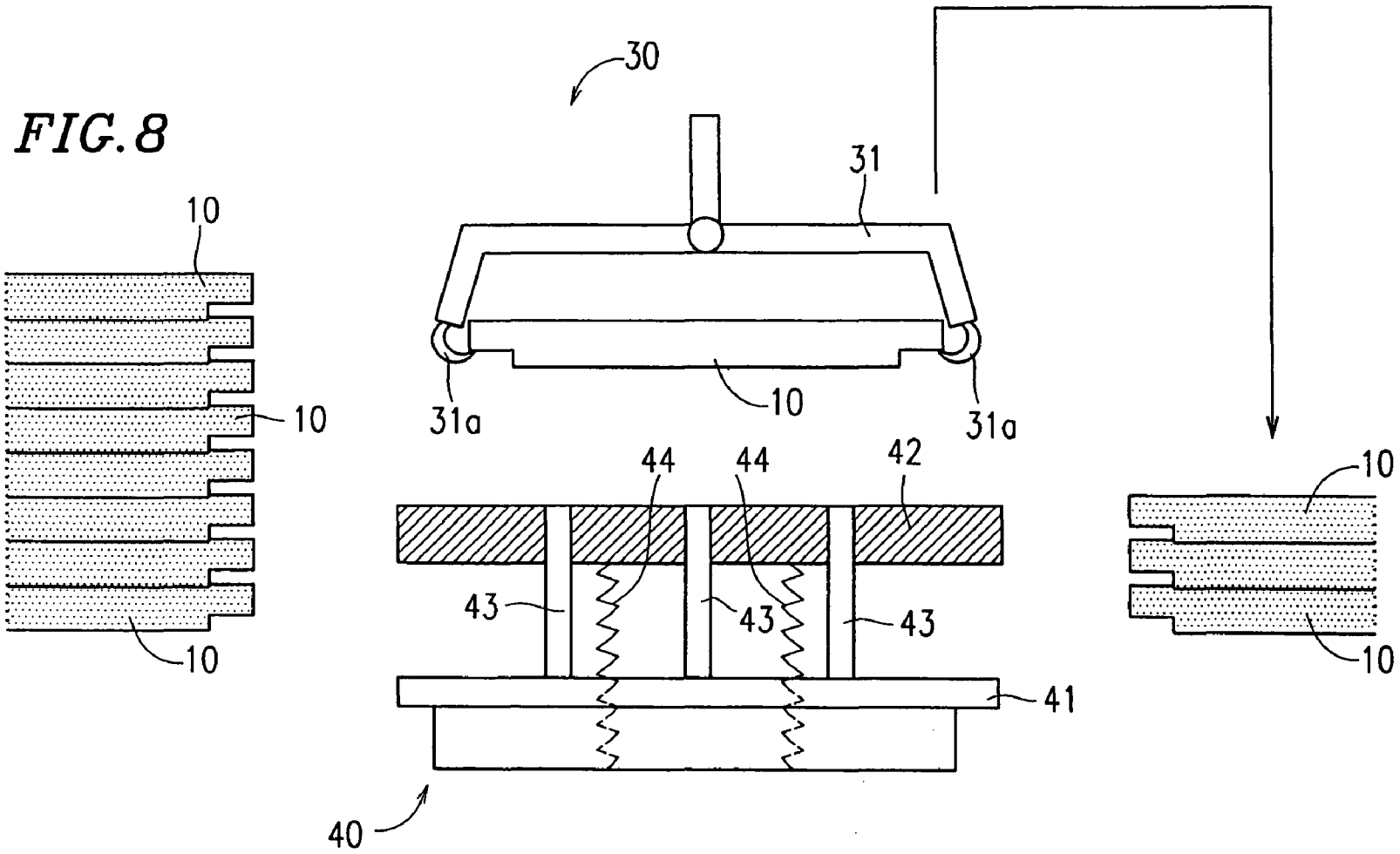
FIG. 8 is a schematic view of the carrying apparatus and the display substrate removing apparatus shown in FIG. 6, illustrating another operation thereof.

With reference to FIGS. 6 through 8, a method for removing the glass substrates 20 from the plurality of vertically stacked display substrate accommodating trays 10 according to the present invention will be described. FIG. 6 shows a carrying apparatus 30 and a display substrate removing apparatus 40 according to an example of the present invention. The carrying apparatus 30 catches and carries each display substrate accommodating tray 10. The display substrate removing apparatus 40 removes a glass substrate 20 from each display substrate accommodating tray 10.

The carrying apparatus 30 is, for example, a crane type carrying apparatus which is movable in an upper space of a plant. The carrying apparatus 30 includes a plurality of chucks 31. (FIG. 6 shows only one chuck 31 for simplicity.) Each chuck 31 includes a pair of chuck nails 31*a*. Each chuck nail 31*a* is engageable with the engaging section 13 of the display substrate accommodating tray 10.

When a plurality of display substrate accommodating trays 10 are carried to a plant, the chuck nails 31*a* of the carrying apparatus 30 are inserted into the gap between the engaging section 13 of an uppermost display substrate accommodating tray 10 and the engaging section 13 of the next uppermost display substrate accommodating tray 10, and are engaged with the engaging section 13 of the uppermost display substrate accommodating tray 10. Then, the chucks 31 are moved upward, and thus the uppermost display substrate accommodating tray 10 is separated from the other display substrate accommodating trays 10 in the stack. The separated display substrate accommodating tray 10 is carried to the display substrate removing apparatus 40 by the chucks 31.

The display substrate removing apparatus 40 includes a fixed table 41 and an elevatable table 42 provided so as to be slidable up and down with respect to the fixed table 41. The fixed table 41 has nine support pins 43, which are arranged in a 3×3 matrix in correspondence with the nine openings 11*a* (FIG. 1) of the bottom section 11 of the display substrate accommodating tray 10. The support pins 43 extend vertically to the elevatable table 42. The elevatable table 42 is supported above the fixed table 41 by a plurality of coil springs 44 so as to slide up and down in a horizontal fashion. The support pins 43 can slidably pass through the elevatable table 42. The elevatable table 42 acts as a supporting member for supporting the display substrate accommodating tray 10.

The display substrate accommodating tray 10 is placed on the elevatable table 42 by the chucks 31. The display substrate accommodating tray 10 is positioned with respect to the elevatable table 42 such that the support pins 43 correspond to the openings 11*a*, respectively. When the chuck nails 31*a* are disengaged from the engaging section 13, the elevatable table 42 slides down by the force of the weight of the display substrate accommodating tray 10 against the coil springs 44. Thus, a top portion of each support pin 43 passes through the elevatable table 42 and projects upward from the elevatable table 42.

Thus, as shown in FIG. 7, the support pins 43 are vertically inserted into the corresponding openings 11*a* and contact the glass substrate 20 mounted on the bottom section 11. The glass substrate 20 is raised from the display substrate accommodating tray 10 by the support pins 43. The glass substrate 20 is supported in a horizontal fashion by the support pins 43 above the display substrate accommodating tray 10. Thus, the glass substrate 20 is removed upwardly from the inside of the display substrate accommodating tray 10, and an appropriate space is provided between the display substrate accommodating tray 10 and the glass substrate 20.

Then, the glass substrate 20 is transferred to a prescribed position by a display substrate adsorption hand (for example, a glass substrate adsorption hand) 50. The display substrate adsorption hand 50, which is commonly used for transferring glass substrates by adsorption, includes a pair of adsorption pads 51 which are parallel to each other. Each adsorption pad 51 is a flat plate having a thickness of about 20 mm or greater, and can vacuum-adsorb a bottom surface of the glass substrate 20. The adsorption pads 51 are inserted between the display substrate accommodating tray 10 and the raised glass substrate 20. The adsorption pads 51 slide upward, so that the glass substrate 20 is placed on, and vacuum-adsorbed by, the adsorption pads 51. Then, the glass substrate 20 and the adsorption pads 51 are raised, and the adsorption pads 51 slide horizontally so as to transfer the glass substrate 20 to a prescribed position.

When the glass substrate 20 is taken to the prescribed position by the display substrate adsorption hand 50, the chuck nails 31*a* are again engaged with the engaging section 13 of the display substrate accommodating tray 10 on the elevatable table 42 as shown in FIG. 8. The chucks 31 are moved upward, so that the display substrate accommodating tray 10 is removed from the elevatable table 42. The display substrate accommodating trays 10 from which the glass substrates 20 have been removed are stacked vertically at another prescribed position.

As described above, the display substrate accommodating tray 10 accommodates only one glass substrate 20. A plurality of such display substrate accommodating trays 10, which are stacked vertically, are transported and stored. Therefore, the glass substrates 20 do not contact each other. Since no space is necessary for inserting the adsorption pads 51 in the display substrate accommodating tray 10, the glass substrate 20 can be directly placed on the bottom section 11. As a result, the glass substrate 20 is not warped and a display substrate accommodating tray 10 can be significantly reduced in thickness.

In order to transfer a glass substrate having a side length of 1.3 m or greater, the adsorption pad 51 needs to have a thickness of 20 mm or greater.

The substrate tray cassette disclosed by Japanese Laid-Open Publication No. 10-287382 has the adsorption pads inserted thereinto. This requires a space of at least 20 mm for inserting the adsorption pads between the bottom section of a substrate tray cassette and a glass substrate. In addition, in order to prevent a glass substrate having a thickness of, for example, 1 mm from contacting a substrate tray cassette to be stacked thereon, the distance between the top surface of the glass substrate and the top surface of the frame is set to be 5 mm. The thickness of the bottom section of the substrate tray cassette is set to be 15 mm. When a plurality of substrate tray cassettes are stacked, the height of each substrate tray cassette, except for the uppermost tray cassette, is at least 41 mm (20+1+5+15=41).

By contrast, the display substrate accommodating tray 10 according to the present invention has a glass substrate 20 having a thickness of, for example, 1 mm directly placed on the bottom section 11. The distance between the top surface of the glass substrate 20 and the top surface of the frame 12 is also set to be 5 mm, and the thickness of the bottom section 11 is also set to be 15 mm. When a plurality of display substrate accommodating trays 10 are stacked, the height of each display substrate accommodating tray 10, except for the uppermost display substrate accommodating tray 10, is 21 mm (1+5+15=21). Thus, the display substrate accommodating tray 10 according to the present invention can be significantly thinner than the conventional substrate tray cassette.

The display substrate accommodating tray 10 according to the present invention, which is significantly thinner, can be significantly more lightweight (for example, about 5 kg). Where one glass substrate 20 weighs 5 kg, the display substrate accommodating tray 10 accommodating the glass substrate 20 weighs about 10 kg. Such a display substrate accommodating tray 10, even accommodating a glass substrate 20, can be easily transported by one worker.

The display substrate accommodating tray 10 includes the engaging section 13 to be engaged with the chuck nails. Owing to this structure, the uppermost display substrate accommodating tray 10 of the stack can be easily separated from the other display substrate accommodating trays 10 of the stack.

Owing to the support pins 43 for supporting the glass substrate 20 being inserted into the openings 11*a* of the bottom section 11, the glass substrate 20 can be easily removed out of the display substrate accommodating tray 10.

The openings 11*a* can have any shape with no specific limitation as long as the support pins 43 can be inserted thereinto. A greater number of openings 11*a* may be formed in the bottom section 11, or the bottom section 11 may be formed to have a lattice structure, as long as the bottom section 11 is sufficiently strong to support the glass substrate 20.

Since each display substrate accommodating tray 10 is lightweight, as many as 20 display substrate accommodating trays 10 can be stacked vertically even when each glass substrate 20 accommodated is as heavy as 5 kg.

In the above example, the positioning step 14 is formed along the entire periphery of the frame 12. The positioning step 14 does not need to be formed along the entire periphery of the frame 12 as long as the vertically stacked display substrate accommodating trays 10 do not slip in a horizontal direction. For example, the positioning step 14 may be formed at four positions in the vicinity of the corners of the display substrate accommodating tray 10. Alternatively, the positioning step 14 may be formed intermittently at appropriate positions around the frame 12.

The engaging section 13 projects outwardly in a horizontal direction from the upper portion of the side surfaces of the frame 12. The engaging section 13 is not limited to such a shape. For example, the engaging section 13 may be formed by tapering the bottom surface of the frame 12 such that the bottom surface is inclined upward toward the periphery. In this case, a recess or inclining portion may be formed in the top surface of the frame 12 as a positioning portion. The engaging section 13 may be, for example, a cut-out section or recessed section made in the side surfaces of the frame 12. The engaging section 13 does not need to be provided along the entire periphery of the frame 12; instead, about 2 or 3 engaging sections may be provided in each side surface.

The carrying apparatus 30 for chucking and carrying the display substrate accommodating tray 10 is not limited to a crane type apparatus movable in the upper space of a plant, but may be a combination of a pair of support rods extending vertically so as to be movable along rails or the like provided on the floor of the plant, and chuck nails provided on the support rods so as to be movable up and down.

In the display substrate removing apparatus 40 for removing a glass substrate 20 from a display substrate accommodating tray 10, the elevatable table 42 is horizontally supported by the coil springs 44. The elevatable table 42 may be moved up and down by ball screws, air cylinders or the like. The support pins 43 may be movable instead of the elevatable table 42. The display substrate accommodating tray 10 may be moved by application of a driving force. Instead of the elevatable table 42, the chucks 31 may act as supporting members for supporting a display substrate accommodating tray 10 while removing a glass substrate 20 from the display substrate accommodating tray 10. The carrying apparatus 30 may be included in the display substrate removing apparatus 40. The supporting member for supporting the display substrate accommodating tray 10 is not limited to the elevatable table 42, but may be any element which can change the relative positions of the display substrate accommodating tray 10 and the support pins 43.

In the above example, the support pins 43 are used for removing a glass substrate 20 from a display substrate accommodating tray 10. Instead of the support pins 43, supporting members having a rod structure, i.e., having a larger top area, may be used.

Figure 9:
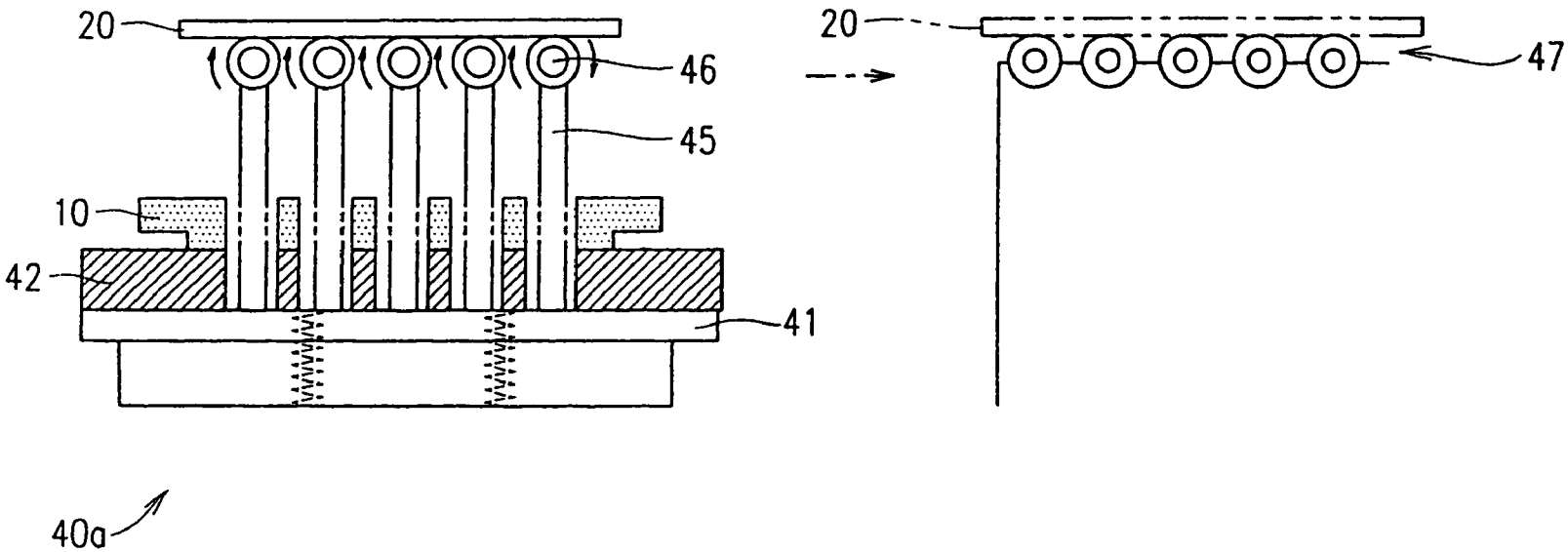
FIG. 9 is a schematic view of a display substrate removing apparatus according to another example of the present invention.

FIG. 9 shows a display substrate removing apparatus 40*a* as a modification of the display substrate removing apparatus 40 shown in FIG. 6. The display substrate removing apparatus 40*a* includes a plurality of rod-like supporting members 45 instead of the plurality of support pins 43. A roller 46 rotatable by a motor or the like is provided at a top end of each supporting member 45. The display substrate removing apparatus 40*a* is identical to the display substrate removing apparatus 40 except for these points. The glass substrate 20 which is raised in contact with the rollers 46 is transferred in a horizontal direction by the rotation of the rollers 46. The glass substrate 20 may be horizontally transferred to a roller transfer apparatus 47 without being raised by the display substrate adsorption hand 50 or the like.

In the above example, an accommodating tray for accommodating a glass substrate for a liquid crystal display panel is described. The present invention is not limited to this, and is applicable to an accommodating tray for accommodating a glass substrate for other types of display panels. The present invention is also applicable to an accommodating tray for accommodating a synthetic resin substrate.

According to the present invention, a plurality of display substrate accommodating trays can be stacked vertically with each display substrate accommodating tray accommodating one display substrate. Therefore, the display substrates accommodated in the display substrate accommodating trays do not contact each other.

Since the bottom section of the display substrate accommodating tray has a plurality of openings, the display substrate can be removed out of the display substrate accommodating tray by inserting the supporting pins into the openings. Owing to such a structure, the display substrate accommodating tray does not need to have any special space for inserting the adsorption pads. This reduces the thickness of the display substrate accommodating tray and increases the space efficiency for transportation and storage.

When stacked vertically, a great number of display substrate accommodating trays can be transported and stored as one unit. It is also possible to handle each display substrate accommodating tray individually by one worker.

The present invention also provides an apparatus and a method for easily removing a display substrate from such a display substrate accommodating tray.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A display substrate accommodating tray, comprising:

a bottom section supports a display substrate on at least a portion of a planar top surface of the bottom section, wherein the portion of the planar top surface supporting the display substrate has a surface area that is at least the majority of the surface area of the bottom surface of the display substrate;

a frame provided along a periphery of the bottom section, the frame projecting to a level higher than a level of the top surface of the bottom section; and a flange-like engaging section, protruding externally from walls of said frame in a substantially horizontal fashion such that a horizontal gap extending to an outer periphery of the display substrate accommodating tray is provided below the flange-like engaging section, to be engaged by a carrying section moving from outside the periphery horizontally into the horizontal gap for carrying the display substrate accommodating tray;

wherein a planar top surface of the frame and a wall defining an inner periphery of the flange-like engaging section define a positional relationship between the display substrate accommodating tray and another display substrate accommodating tray which is to be stacked thereon, wherein the planar top surface of said frame is parallel to the planar top surface of the bottom section having the display substrate and the wall of the flange-like engaging section is connected to said planar surface of said frame, wherein the wall of the flange-like engaging section projects to a level higher than the level of the planar top surface of the frame with respect to the surface of the bottom section, and the width of the frame is substantially larger than the distance between the top of the top surface of the frame and the top surface of the bottom section.

2. A display substrate accommodating tray according to claim 1, wherein the bottom section and the frame are integrally formed from a synthetic resin foam material.

3. An apparatus for removing a display substrate from a display substrate accommodating tray, the display substrate accommodating tray including:

a bottom section adapted to mount a display substrate thereon in a substantially horizontal fashion, with a plurality of openings being formed in the bottom section, a frame for surrounding at least a part of the display substrate when the display substrate is mounted on the bottom section, and an engaging section extending from a side surface of the frame, the apparatus comprising:

a plurality of first supporting members adapted to, while the display substrate is mounted on the bottom section, raise the display substrate above the bottom section; and a second supporting member for supporting the display substrate accommodating tray while the display substrate is being raised above the accommodating tray, wherein the plurality of first supporting members are adapted to raise the display substrate by being inserted into the plurality of openings respectively and penetrating through the bottom section and moving the display substrate upward from the display substrate accommodating tray, and wherein the second supporting member is adapted to move upwards or downwards.

4. An apparatus according to claim 3, wherein the plurality of first supporting members are inserted into the plurality of openings vertically.

5. An apparatus according to claim 3, wherein an engaging section extends from a side surface of the frame.

6. An apparatus according to claim 3, wherein the second supporting member is supported by at least one of a spring, a ball screw or an air cylinder, so as to allow the second supporting member to move upwards or downwards.

7. An apparatus according to claim 3, wherein each of the first supporting members is a rod having a top portion which is larger than a remaining portion of the rod.

8. An apparatus according to claim 3, wherein each of the first supporting members has a roller provided at a top end thereof.

9. A method for removing a display substrate from a display substrate accommodating tray, the display substrate accommodating tray including:

a bottom section for mounting the display substrate thereon in a substantially horizontal fashion, with a plurality of openings being formed in the bottom section, a frame for surrounding at least a part of the display substrate when the display substrate is mounted on the bottom section, and an engaging section, extending from a side surface of said frame, to be engaged by a carrying mechanism for carrying the display substrate accommodating tray having the display substrate mounted thereon;

the method comprising the steps of:

while the display substrate is mounted on the bottom section, engaging the display substrate accommodating tray at the engaging section by said carrying mechanism from above the accommodating tray, and positioning the openings of the bottom section to be coincident with a position of a plurality of supporting members and positioning the rest of the bottom section to be coincident with a position of a second supporting member, said second supporting member adapted to be pushed downwards by said accommodating tray when said accommodating tray is placed thereupon, and said second supporting member adapted to move upwards when said accommodating tray is being removed;

placing said tray onto said second supporting member, so that said plurality of supporting members move upward relative to the display substrate accommodating tray, thereby inserting the plurality of supporting members into the plurality of openings respectively; and raising the display substrate above the bottom section by penetrating the plurality of supporting members through the accommodating tray.

10. A display substrate accommodating tray, comprising:

a bottom section supports a display substrate on at least a portion of a planar top surface of the bottom section, wherein the portion of the planar top surface supporting the display substrate is at least the area of the majority of the bottom surface area of the display substrate;

a frame for surrounding at least a part of the display substrate when the display substrate is mounted on the bottom section; and a flange-like engaging section, protruding externally from walls of the frame in a substantially horizontal fashion such that a horizontal gap extending to an outer periphery of the display substrate accommodating tray is provided below the flange-like engaging section, to be engaged by a carrying section moving from outside the periphery horizontally into the horizontal gap for carrying the display substrate accommodating tray;

wherein a planar top surface of the frame and a wall defining an inner periphery of the flange-like engaging section define a positional relationship between the display substrate accommodating tray and another display substrate accommodating tray which is to be stacked thereon, wherein the planar top surface of said frame is parallel to the planar top surface of the bottom section having the display substrate and the wall of the flange-like engaging section is connected to said planar surface of said frame, wherein the wall of the flange-like engaging section projects to a level higher than the level of the planar top surface of the frame with respect to the surface of the bottom section, a plurality of openings are formed in the bottom section, the frame projects to a level higher than a level of a top surface of the bottom section, and the width of the frame is substantially larger than the distance between the top surface of the frame and the top surface of the bottom section.

11. A display substrate accommodating tray according to claim 10, wherein the bottom section and the frame are integrally formed from a synthetic resin foam material.

* * * * *